US005839965A

United States Patent [19]

Mullins

[11] Patent Number: 5,839,965

[45] Date of Patent: Nov. 24, 1998

[54] CHILD SWING HARNESS

[76] Inventor: Lora Mullins, 1589 Windsor Dr., Charleston, W. Va. 25311

[21] Appl. No.: 986,995

[22] Filed: Dec. 8, 1997

[51] Int. Cl.[6] ..... A63G 9/00

[52] U.S. Cl. ..... 472/118; 472/133; 297/485

[58] Field of Search ..... 472/118, 119, 472/133; 297/485, 484, 467

[56] References Cited

U.S. PATENT DOCUMENTS

| | | | |
|---|---|---|---|
| D. 316,135 | 4/1991 | Barber, Jr. | D21/246 |
| 3,954,280 | 5/1976 | Roberts et al. | 280/744 |
| 4,382,595 | 5/1983 | Tolar | 272/85 |
| 4,440,331 | 4/1984 | Schimmels | 224/31 |
| 4,706,952 | 11/1987 | Shannon et al. | 272/85 |
| 4,927,211 | 5/1990 | Bolcerek | 297/465 |
| 5,226,698 | 7/1993 | Harrison | 297/485 |
| 5,310,199 | 5/1994 | Korkin | 280/87.01 |
| 5,334,099 | 8/1994 | Marra et al. | 472/118 |
| 5,397,171 | 3/1995 | Leach | 297/485 |
| 5,435,272 | 7/1995 | Epstein | 119/770 |
| 5,533,934 | 7/1996 | Miller | 472/118 |
| 5,628,548 | 5/1997 | Lacoste | 297/484 |
| 5,676,426 | 10/1997 | Herring | 297/484 |
| 5,733,014 | 3/1998 | Murray | 297/485 |

*Primary Examiner*—Kien T. Nguyen
*Attorney, Agent, or Firm*—Steptoe & Johnson

[57] ABSTRACT

The present invention is an apparatus for converting a conventional swing into a toddler swing by providing a child swing harness that can be quickly and easily placed around a child and attached to a conventional swing. The child swing harness of the present invention comprises a waist strap, two shoulder straps, an optional swing stabilizer, two top stabilizers, and two optional waist stabilizers. The waist strap and two shoulder straps provide a harness for a small child. The swing stabilizer runs under the swing seat from the front of the waist strap to the back of the waist strap, thereby holding the child on a swing seat. The waist stabilizers and top stabilizers connect the child swing harness of the present invention to the lines of the swing. These stabilizers prevent the child from falling forward or backward off of the swing seat.

19 Claims, 3 Drawing Sheets

CHILD SWING HARNESS

BACKGROUND OF THE INVENTION

1. Field of the Invention

This invention relates to harnesses, and more specifically, to a harness for holding and supporting a child on a conventional swing.

2. Related Art

Conventional swings and toddler swings are well known in the relevant art and have been commercially available for many years. A conventional toddler swing is typically a bucket type swing in which a small child is placed providing surrounding support for holding the small child in the swing. The small child does not have to keep his/her balance, nor does he/she have to hold onto the swing lines from which the swing is suspended.

In contrast a conventional swing is a straight or sling seat suspended from ropes, chains, or other type of lines. There are no means for securing a child to the conventional swing to prevent falling. A child swings on a conventional swing by sitting on the swing seat, holding onto the swing lines and pumping his/her legs for momentum.

There are many times when a parent or guardian of a small child is at a park or in a backyard and want to use the playground equipment, only to be frustrated with the available swingsets. More often than not, the swingset does not have a toddler swing, or if it does have a toddler swing, the toddler swing is broken. In either case, the parent cannot swing the child because only conventional swings are available for use.

A small child cannot use a conventional swing because he/she does not have the balance or arm strength to stay on a conventional swing seat. While swinging, the child may easily fall forward or backward resulting in serious injury. For these reasons, parents of a small child use a conventional toddler swing to swing their child. Therefore, parents must have a toddler swing with them or rely on the availability of a toddler swing on an existing swingset.

Therefore, there is a need for an apparatus that allows a parent or guardian to simply and quickly convert a conventional swing into a swing that a small child can use and enjoy. A parent would not have to rely on the availability of a toddler swing in order for the child to swing. The parent could use any conventional swing to swing the child.

In addition, parents of multiple children often are frustrated with the arrangement of swingsets in a typical playground. In many playgrounds that have toddler swings, the toddler swings are located away from swingsets having conventional swings. Therefore, a parent is pulled into two different directions with an older child wanting to swing on a conventional swing and the smaller child having to swing in a toddler swing. Parents, however, will not allow themselves to be separated from both of their children at a public park due to the increase in crime in today's society. Therefore, one child will not be able to swing while the parent attends to the other child.

Therefore, there is a need for an apparatus that allows a parent or guardian to simply and quickly convert a conventional swing into a swing that a small child can use and enjoy. With such an apparatus, a parent can keep both children together and swinging on the same swingset. The older child would be able to swing using a conventional swing while the smaller child can swing next to the older child in a conventional swing converted into a toddler swing.

SUMMARY OF THE INVENTION

The present invention solves the problems associated with conventional swings and conventional toddler swings by providing a child swing harness that a parent can put on a small child quickly and easily and then secure the harness to a conventional swing thereby converting the conventional swing into a toddler swing.

The child swing harness of the present invention is made of woven nylon straps and plastic locking buckles. The harness portion has a waist strap that fits around a child's waist and two shoulder straps that connect the front of the waist strap to the back of the waist strap by running over the child's two shoulders.

The child swing harness is secured to a conventional swing in five places. First, a swing stabilizer strap runs from the front of the waist strap to the back of the waist strap by running under the seat of the conventional swing. This stabilizer ensures that the child does not slip off of the seat, but rather stays on the seat while swinging.

Second, two waist stabilizers are attached to the waist strap, one on each side of the child. There are hooks, or other attachment means, located at the ends of the waist stabilizers that secure to the lines of the swing.

Third, similar to the waist stabilizers, there are two top stabilizers each of which is attached to a shoulder strap behind the child. At the ends of the top stabilizers there are also hooks, or other attachment means, for securing the child swing harness to the lines of the swing. The top stabilizers are attached to the swing lines above the waist stabilizers.

There are numerous advantages of the child swing harness of the present invention. First, the child swing harness is very lightweight and portable because it is made of woven nylon straps. The child swing harness can be easily folded and placed in a purse, diaper bag, glove compartment of a car, or can even be carried while carrying the child. In contrast, conventional toddler swings are heavy, bulky and cumbersome, requiring large storage space and awkward handling.

Second, the child swing harness is very easy to use with a child. The harness is buckled on a child and attached to any swing very easily and quickly. There are no complicated moving parts or bulky pieces.

Third, the child swing harness is very adaptable and works on any type of conventional swing, including but not limited to, a swing with a straight board seat or a sling seat. Further, the child swing harness may be used with other types of playground equipment.

Fourth, the child harness swing provides a safe and secure method for incrementally teaching a small child how to swing on a conventional swing. For example, when a child is very small and is just learning how to swing, the parent or guardian may attach all five of the stabilizers to the swing, thereby providing the child with maximum support. As the child becomes more comfortable and secure with swinging, the parent may detach one or more of the stabilizers, most likely detaching the waist stabilizers first. The parent also may lower the top stabilizers on the swing lines to give the child more freedom in swinging, yet be available as a backup system if the child loses his/her balance. This way the child still has some security with the top stabilizers and swing stabilizer as he/she is starting to swing on his/her own. When the child becomes very proficient with swinging, the parent may remove the entire child swing harness. Therefore, the child swing harness of the present invention provides a secure method for incrementally teaching a child how to swing.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
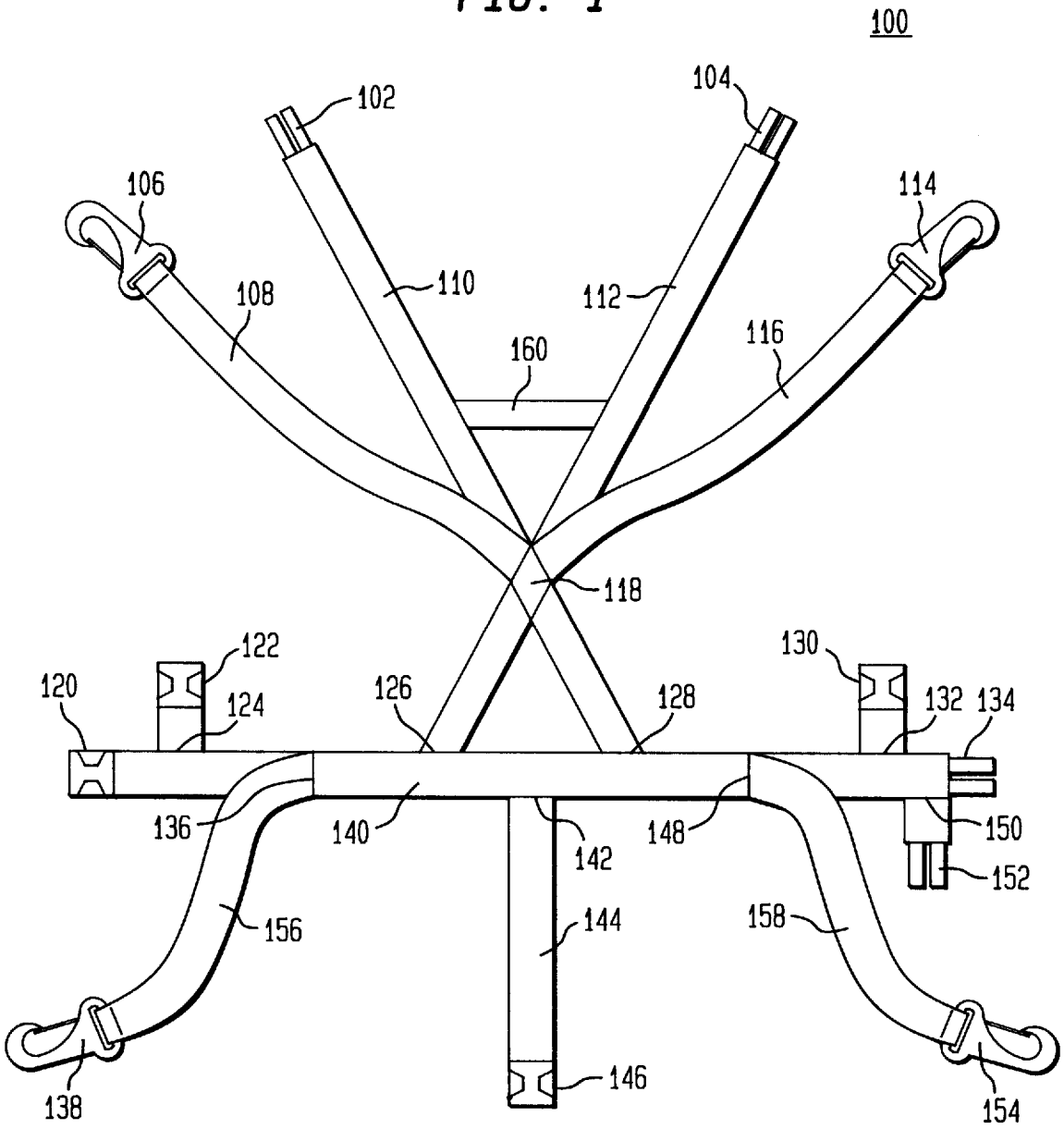
FIG. 1 illustrates a child swing harness of the present invention.

FIG. 1 illustrates the preferred embodiment of the child swing harness 100 of the present invention. The child swing harness 100 comprises a waist strap 140, two shoulder straps 110, 112, a swing stabilizer 144, two waist stabilizers 156, 158, and two top stabilizers 108, 116. Together, the waist strap 140 and shoulder straps 110, 112 are the main harness of the present invention, while the swing stabilizer 144, waist stabilizers 156, 158 and top stabilizers 108, 116 provide a means for securing the child swing harness 100 to a conventional swing.

In the preferred embodiment, the child swing harness 100 is made of 1½ inch wide nylon straps for comfort, durability, portability and ease of manufacturing. The nylon straps are stitched together to form the child swing harness 100, incorporating locking buckles, or other means for attaching two ends of a strap together, and locking hooks as needed. Nylon straps, locking buckles, and locking hooks are well known in the relevant art and are commercially available. It would be readily apparent to one of ordinary skill in the relevant art to manufacture a child swing harness 100 of the present invention using such nylon straps and stitching them together or incorporating buckles and hooks as required.

The waist strap 140 of the child swing harness 100 is a nylon strap, having a length that is long enough to fit around the waist of a child and a means of attaching and removing the waist strap from around the child's waist. In the preferred embodiment, the means for attaching and removing the waist strap 140 is a plastic locking buckle wherein one end 134 fits, or snaps, into a second end 120, thereby securing the waist strap 140 around the child's waist.

In an alternative embodiment, the waist strap 140 may incorporate another means for attaching and removing the waist strap 140 from around a child's waist. For example, the waist strap 140 may have a hook and eye mechanism of a conventional belt, Velcro on the ends of the waist strap 140, a slidably adjustable belting mechanism, or any other comparable means of securing the waist strap 140 around a child's waist. It would be readily apparent to one of ordinary skill in the relevant art to use such a comparable means of securing and adjusting the length of the waist strap 140.

The child swing harness 100 also has two shoulder straps 110, 112 that hold the waist strap 140 in place around the child and support the child while swinging. The shoulder straps 110, 112 are attached at back points 126, 128 to the back of the waist strap 140, run over the child's shoulders and attach to the front of the waist strap 140 at front points 124, 132. In the preferred embodiment, the shoulder straps 110, 112 cross in the back of the child at a back center point 118, running over the opposite shoulders to the front of the child. The crossing of the shoulder straps 110, 112 provides extra stability and security of the child in the child swing harness 100.

Also in the preferred embodiment, the shoulder straps 110, 112 are detachable from the waist strap 140 in the front. More specifically, the shoulder straps 110, 112 are attached to the front of the waist strap 140 by means of a locking buckle. Each locking buckle of the shoulder straps 110, 112 has one end 102, 104 that fits, or snaps, into a second end 122, 130, thereby securing the shoulder straps 110, 112 over the child's shoulders and connecting to the waist strap 140. These locking buckles on the shoulder straps 110, 112 provide a quick and easy method for putting the child swing harness 100 on and taking the child swing harness 100 off a child.

In an alternative embodiment, the child swing harness has a head strap 160, connecting the shoulder straps 110, 112 in back of the child. The head strap 160 is a horizontal strap that is stitched at approximately a child's head height between the shoulder straps 110, 112. The head strap 160 provides extra head control for the child while in the swing so the child's head does not whip back and forth incurring muscle or other injury. If the shoulder straps 110, 112 are crossed in the back of the child, the head strap 160 is located above the center back point 118.

In an alternative embodiment, the waist strap 140 and shoulder straps 110, 112 may incorporate a means for adjusting the length of the straps in order to secure the waist strap 140 close around the child's waist and the shoulder straps 110, 112 over the child's shoulders. In the preferred embodiment the means for adjusting a strap of the child swing harness 100 is a slidable framework whereby the strap is woven through the framework and can be lengthened or shortened by sliding the framework along the strap as required. Slidable adjusting frameworks are well known in the relevant art and are commercially available. It would be readily apparent to one of ordinary skill in the relevant art to incorporate such a slidable adjusting framework or comparable means for adjusting into a strap of the present invention.

In the preferred embodiment, there are five (5) means by which the child swing harness 100 is secured to a conventional swing: a swing stabilizer 144, two waist stabilizers 156, 158, and two top stabilizers 108, 116. The swing stabilizer 144 is a strap that connects the front of the waist strap 140 to the back of the waist strap 140 by running under a swing seat, thereby allowing the child to stay in contact with the swing seat while swinging. The swing stabilizer 144 is stitched to the center 142 of the back of the waist strap 140 and is connected to the front 150 of the waist strap 140 by a locking buckle. The buckle allows the swing stabilizer 144 to be easily attached to or removed from under the swing seat. The buckle has one end 152 that fits, or snaps, into a second end 146, thereby securing the swing stabilizer 144 to the swing seat.

In an alternative embodiment, the swing stabilizer 144 is optional or removable. That is, the child swing harness 100 is only supported via the waist stabilizers 156, 158 and the top stabilizers 108, 116. The child swing harness 100 either does not have a swing stabilizer 144 or has a swing stabilizer 144 that is completely detachable and removable from the child swing harness 100. In this embodiment, the swing stabilizer 144 is secured to the waist strap 140 by some means for attachment, such as a second locking buckle, Velcro, or the like. This embodiment of the child swing harness 100 is beneficial for older children who are close to mastering the art of swinging or for children playing on different types of playground equipment for which a swing stabilizer 144 is not required.

The child swing harness 100 of the present invention has one top stabilizer 108, 116 attached to each shoulder strap 110, 112. Each top stabilizer 108, 116 has a harness end that is stitched to a shoulder strap 10, 112 of the child swing harness 100 such that a top stabilizer 108, 116 is located at each of the child's shoulders when the child is wearing the child swing harness 100. In the preferred embodiment, the shoulder straps 110, 112 cross in the back of the child and the top stabilizers 108, 116 attach to the shoulder straps 110, 112 at the center back point 118.

Each top stabilizer 108, 116 also incorporates a means for attaching the child swing harness 100 to a swing line. In the preferred embodiment, there is a locking hook 106, 114 at the end of each top stabilizer 108, 116 that is used to connect the top stabilizers 108, 116 to the lines of the swing. Most conventional swing lines are chains; therefore, a locking hook 106, 114 fits through a link in the chain and locks so that the locking hook 106, 114 does not disengage from the swing line while the child is swinging.

In operation, a parent connects one top stabilizer 108 to a first swing line at a point above the child's shoulder such that the top stabilizer 108 is taut. The parent then connects the other top stabilizer 116 to a second swing line at a point above the child's shoulder such that the top stabilizer 116 is taut.

In the preferred embodiment of the present invention, there is one waist stabilizer 156, 158 located on each side of the waist strap 140. Each waist stabilizer 156, 158 has a harness end 136, 148 that is stitched to the waist strap 140 of the child swing harness 100 such that a waist stabilizer 156, 158 is located at each side of the child when the child is wearing the child swing harness 100.

Each waist stabilizer 156, 158 also incorporates a means for attaching the child swing harness 100 to a swing line. In the preferred embodiment, there is a locking hook 138, 154 at the end of each waist stabilizer 156, 158 that is used to connect the waist stabilizers 156, 158 to the lines of the swing. The locking hooks 138, 154 of the waist stabilizers 156, 158 fiction identical to the locking hooks 106, 114 of the top stabilizers 108, 116.

In operation, a parent connects one waist stabilizer 156 to a first swing line such that the waist stabilizer 156 is taut and at a point below the point at which the corresponding top stabilizer 108 is connected. Then, the other waist stabilizer 158 is connected to a second swing line such that the waist stabilizer 158 is taut and at a point below the point at which the corresponding top stabilizer 116 is connected.

In an alternative embodiment, the waist stabilizers 156, 158 are optionally removable from the child swing harness 100 of the present invention. Such removable waist stabilizers 156, 158 are beneficial as a child becomes a better swinger and does not require the full support of the child swing harness. In this embodiment, the waist stabilizers 156, 158 are secured to the waist strap 140 by some means for attachment, such as a locking buckle or the like.

The top stabilizers 108, 116 and waist stabilizers 156, 158 are described in terms of locking hooks for convenience purpose only. It would be readily apparent to one of ordinary skill in the relevant art to incorporate a comparable means, e.g., Velcro straps, for attaching the top stabilizers 108, 116 and waist stabilizers 156, 158 to the lines of a swing. This is especially useful for conventional swing lines that are not just chains, but are chains covered with a plastic sleeve or ropes.

The child swing harness 100 of the present invention is described in these terms for convenience purpose only. It would be readily apparent to one of ordinary skill in the relevant art to manufacture a comparable child swing harness 100 using a different material (e.g., stretching elastic material), different lengths of the straps, straps of adjustable length, different buckle placement or a comparable design.

Figure 2:
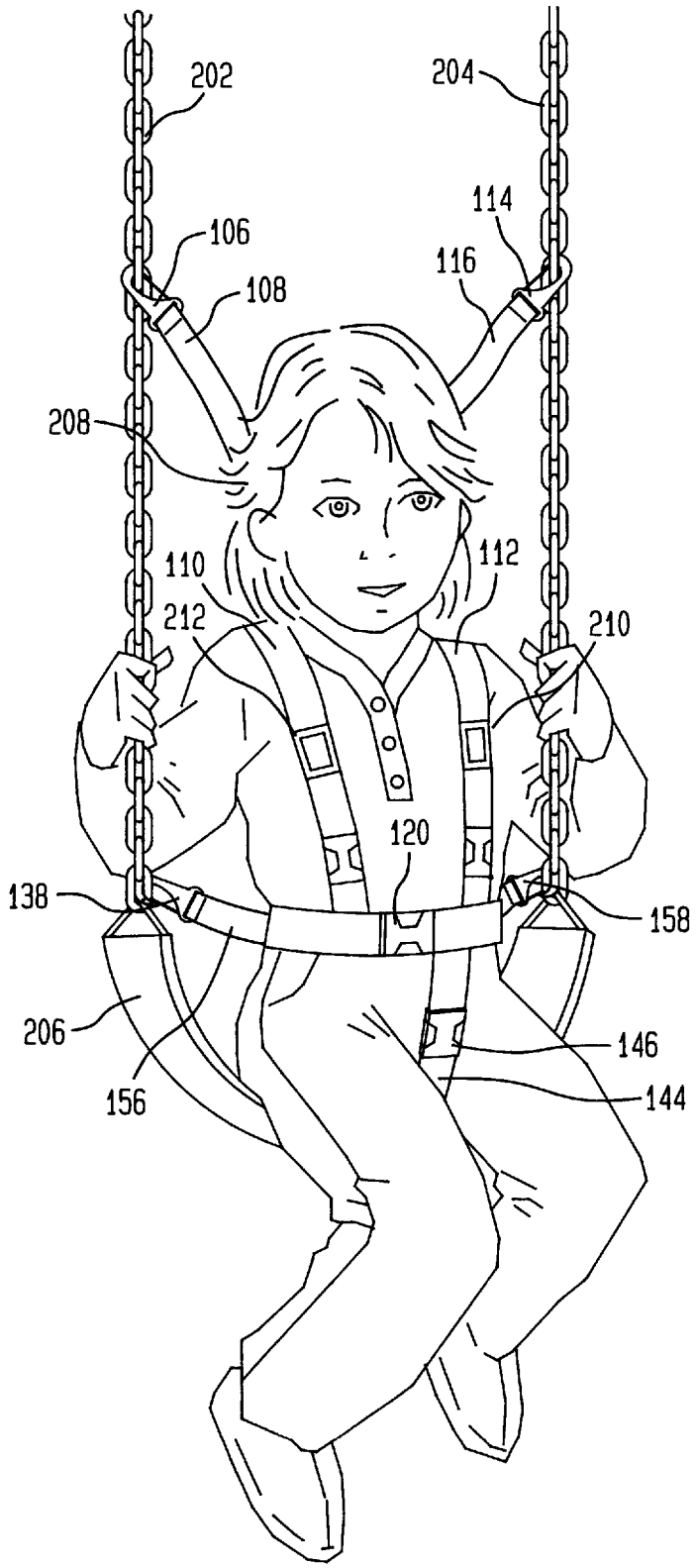
FIG. 2 is a perspective front view of a child swinging in a conventional swing using the child swing harness.
Figure 3:
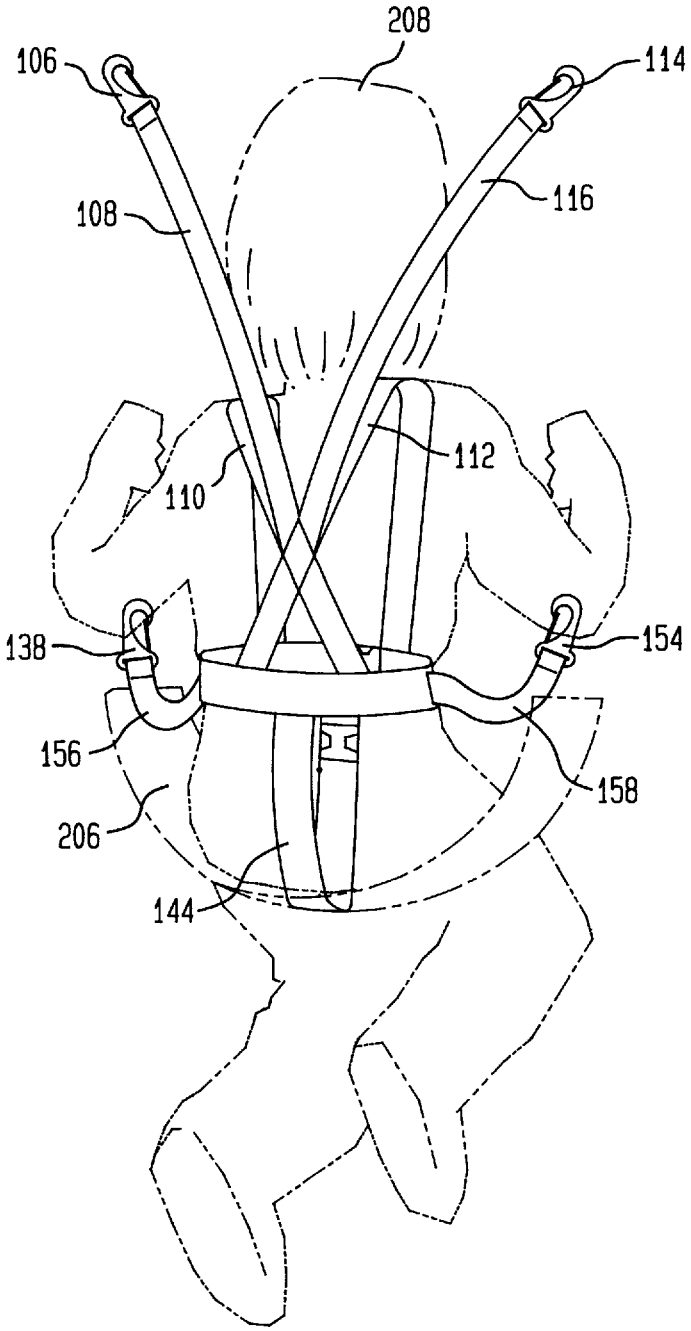
FIG. 3 is a perspective rear view of the child swinging in a conventional swing using the child swing harness.

FIGS. 2 and 3 illustrate the child swing harness 100 of the present invention as used with a child 208 on a conventional swing. The conventional swing has a swing seat 206 suspended from a first swing line 202 and a second swing line 204. The swing seat 206 is shown on these figures as a sling seat for convenience purpose only. The child swing harness 100 of the present invention also works with other types of swing seats straight board swing seats.

In operation, a parent or guardian puts a child swing harness 100 on a child 208. First, the waist strap 140 is put around the child's waist and buckled into place. Next, the shoulder straps 110, 112 are put over the child's shoulders and buckled to the waist strap 140. The waist strap 140 and shoulder straps 110, 112 are tightened around the child such that the child swing harness 100 is snug on the child.

The child 208 is then placed on the swing seat 206 and the child swing harness 100 is attached, in varying order, to the swing seat 206, the first swing line 202 and the second swing line 204. In the preferred operation, first the swing stabilizer 144 is run under the swing seat 206 and the buckle is locked into place thereby connecting the swing stabilizer 144 to the waist strap 140.

Next, one top stabilizer 108 is attached to a point on the first swing line 202 above the height of the child's shoulder such that the top stabilizer 108 is taunt. The second top stabilizer 116 is attached to a point on the second swing line 204 also above the height of the child's shoulder such that the second top stabilizer 116 is taunt. Alternatively, the two top stabilizers 108, 116 may be positioned on the swing lines 202, 204 such that the top stabilizers 108, 116 are not taunt, thereby providing the child 208 with the means to learn how to swing but still be there as an emergency safety line.

Next, one waist stabilizer 156 is attached to a point on the first swing line 202 at the child's side such that the waist stabilizer 156 is below the point where the top stabilizer 108 is connected. The second waist stabilizer 158 is attached to a point on the second swing line 204 at the child's side such that the second waist stabilizer 158 is below the point where the second top stabilizer 116 is connected. Both waist stabilizers 156, 158 should be taunt to provide the child with support while swinging.

Alternatively, the waist stabilizers 156 and the swing stabilizer 144 are optional in that they may not be used as a child becomes accustom to swinging and does not need the full support of the child swing harness 100.

Conclusion

While various embodiments of the present invention have been described above, it should be understood that they have been presented by the way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined in accordance with the following claims and their equivalents.

What is claimed is:

1. A child swing harness for supporting a child on a swing, the swing having a swing seat and a first swing line and a second swing line wherein the swing seat is suspended by the first swing line and the second swing line, comprising:

a waist strap having a front, back, first side, second side, and a means for attaching and removing said waist strap around the child's waist such that when said waist strap is placed around the child's waist, said front of said waist strap adapted to locate in the child's front, said back of said waist strap adapted to locate in the child's back, said first side of said waist strap adapted to locate at the child's side, and said second side of said waist strap is located at the child's other side;

a first shoulder strap having a first front end and a first back end, said first front end connected to said front of said waist strap, said first back end connected to said back of said waist strap, such that when the child swing harness is placed on the child, said first shoulder strap runs from the child's front to the child's back over a first shoulder of the child;

a second shoulder strap having a second front end and a second back end, said second front end connected to said front of said waist strap, said second back end connected to said back of said waist strap, such that when the child swing harness is placed on the child, said second shoulder strap runs from the child's front to the child's back over a second shoulder of the child;

a swing stabilizer strap having a front end, a back end and a means for attaching and removing said swing stabilizer strap under the swing seat, said front end connected to said front of said waist strap, said back end connected to said back of said waist strap, such that when the child swing harness is placed on the child, said swing stabilizer strap runs from the child's front to the child's back under the swing seat;

a first top stabilizer having a first top harness end and a first high connection means for connecting said first top stabilizer to the first swing line at a first high connection point, said first top harness end connected to said first shoulder strap; and a second top stabilizer having a second top harness end and a second high connection means for connecting said second top stabilizer to the second swing line at a second high connection point, said second top harness end connected to said second shoulder strap.

2. The child swing harness according to claim 1, further comprising:

a first waist stabilizer having a first waist harness end and a first low connection means for connecting said first waist stabilizer to the first swing line at a first low connection point below said first top connection point, said first waist harness end connected to said first side of said waist strap; and a second waist stabilizer having a second waist harness end and a second low connection means for connecting said second waist stabilizer to the second swing line at a second low connection point below said second top connection point, said second waist harness end connected to said second side of said waist strap.

3. The child swing harness according to claim 2, wherein said first low connection means, said second low connection means, said first high connection means, and said second high connection means are locking hooks.

4. The child swing harness according to claim 2, wherein said first low connection means, said second low connection means, said first high connection means, and said second high connection means are velcro straps.

5. The child swing harness according to claim 1, further comprising:

a head stabilizer having a first end connected to said first shoulder strap and a second end connected to said second shoulder strap wherein said head stabilizer is at a height of the child's head.

6. The child swing harness according to claim 1, wherein said first shoulder strap and said second shoulder strap are adapted to cris-cross in the child's back at a center back connection point.

7. The child swing harness according to claim 6, wherein said first top stabilizer strap and said second top stabilizer strap connect to the child swing harness at said center back connection point.

8. The child swing harness according to claim 1, wherein said means for attaching and removing said waist strap and said means for attaching and removing said swing stabilizer strap are locking buckles.

9. The child swing harness according to claim 1, wherein said first shoulder strap comprises a first means for adjusting a length of said first shoulder strap, and said second shoulder strap comprises a second means for adjusting a length of said second shoulder strap.

10. The child swing harness according to claim 9, wherein said first means for adjusting and said second means for adjusting are adjustable sliding clips.

11. The child swing harness according to claim 1, wherein said first shoulder strap and said second shoulder strap each comprise a means for removably attaching to and removing from said waist strap.

12. The child swing harness according to claim 11, wherein said means for removably attaching to and removing from said waist strap is a locking buckle.

13. The child swing harness according to claim 1, wherein said first top stabilizer is connected to said first shoulder strap and said second top stabilizer is connected to said second shoulder strap behind the child.

14. The child swing harness according to claim 1, wherein said waist strap comprises a means for adjusting a length of said waist strap such that said waist strap fits close around the child's waist.

15. The child swing harness according to claim 14, wherein said means for adjusting are sliding adjustable frameworks.

16. The child swing harness according to claim 1, wherein said waist strap, said first shoulder strap, said second shoulder strap, said swing stabilizer, said first top stabilizer, and said second top stabilizer are made of nylon straps.

17. The child swing harness according to claim 1, where said first shoulder strap and said second strap are made of stretching elastic nylon straps.

18. The child swing harness according to claim 1, wherein said waist strap is made of a stretching nylon strap.

19. A child swing harness for supporting a child on a swing, the swing having a swing seat and a first swing line and a second swing line wherein the swing seat is suspended by the first swing line and the second swing line, comprising:

a waist strap having a front, back, first side, second side, and a means for attaching and removing said waist strap around the child's waist such that when said waist strap is placed around the child's waist, said front of said waist strap adapted to locate in the child's front, said back of said waist strap adapted to locate in the child's back, said first side of said waist strap adapted to locate at the child's side, and said second side of said waist strap adapted to locate at the child's other side;

a first shoulder strap having a first front end and a first back end, said first front end connected to said front of said waist strap, said first back end connected to said back of said waist strap, such that when the child swing harness is placed on the child, said first shoulder strap runs from the child's front to the child's back over a first shoulder of the child;

a second shoulder strap having a second front end and a second back end, said second front end connected to said front of said waist strap, said second back end connected to said back of said waist strap, such that when the child swing harness is placed on the child, said second shoulder strap runs from the child's front to the child's back over a second shoulder of the child;

a first top stabilizer having a first top harness end and a first high connection means for connecting said first top stabilizer to the first swing line at a first high connection point, said first top harness end connected to said first shoulder strap; and a second top stabilizer having a second top harness end and a second high connection means for connecting said second top stabilizer to the second swing line at a second high connection point, said second top harness end connected to said second shoulder strap.

* * * * *